US008004548B2

(12) United States Patent
Muraki et al.

(10) Patent No.: US 8,004,548 B2
(45) Date of Patent: Aug. 23, 2011

(54) THERMAL HEAD AND IMAGE FORMING APPARATUS USING THE SAME

(75) Inventors: Kaoru Muraki, Kyoto (JP); Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 271 days.

(21) Appl. No.: 12/516,021

(22) PCT Filed: May 20, 2008

(86) PCT No.: PCT/JP2008/059174

§ 371 (c)(1), (2), (4) Date: May 22, 2009

(87) PCT Pub. No.: WO2008/146647

PCT Pub. Date: Dec. 4, 2008

(65) Prior Publication Data

US 2010/0053295 A1 Mar. 4, 2010

(30) Foreign Application Priority Data

May 31, 2007 (JP) ..... 2007-144637

(51) Int. Cl.
*B41J 2/34* (2006.01)

(52) U.S. Cl. ..... 347/211

(58) Field of Classification Search ..... 347/211
See application file for complete search history.

(56) References Cited

U.S. PATENT DOCUMENTS

| | | | |
|---|---|---|---|
| 5,483,273 | A | 1/1996 | Fujimoto et al. |
| 6,726,298 | B2 | 4/2004 | Anderson et al. |
| 2003/0020771 | A1 | 1/2003 | Rehmann et al. |
| 2003/0025740 | A1 | 2/2003 | Rehmann et al. |

FOREIGN PATENT DOCUMENTS

| | | |
|---|---|---|
| JP | 04-016364 | 1/1992 |
| JP | 04-016365 | 1/1992 |
| JP | 04-305471 | 10/1992 |
| JP | 04-323048 | 11/1992 |
| JP | 2000-301754 | 10/2000 |
| JP | 2002-326348 | 11/2002 |
| JP | 2003-072074 | 3/2003 |
| JP | 2006-198910 | 8/2006 |

OTHER PUBLICATIONS

International Preliminary Report for PCT/JP2008/059174, issued on Jan. 12, 2010.*

* cited by examiner

*Primary Examiner* — Huan H Tran
(74) *Attorney, Agent, or Firm* — Fish & Richardson P.C.

(57) ABSTRACT

In a thermal head 10 of the present invention, a head-side I/F 13 includes: an LVDS receiver 131 that receives a low-voltage differential signal from a set-side I/F 20 and converts the low-voltage differential signal into a single-end signal that is then outputted; a decoder 132 that divides an output from the LVDS receiver 131 into a data signal string DAT and a trigger signal TG; and a clock generating section 133 that generates a clock signal CLK that is synchronized by the trigger signal TG, and a driver circuit 12 reads a print data signal DI and various control signals in response to the clock signal CLK and drives a heat generating element according to the print data signal DI and the various control signals.

9 Claims, 4 Drawing Sheets

THERMAL HEAD AND IMAGE FORMING APPARATUS USING THE SAME

TECHNICAL FIELD

The present invention relates to a thermal head and an image forming apparatus using this.

BACKGROUND ART

FIG. 3 is a diagram showing an example of a conventional thermal head.

As shown in this figure, a conventional thermal head 10' is typically provided with: a heat generating resistor element array 11 in which a plurality of heat generating resistor elements corresponding to print dots are arranged in a line; and a driver circuit (driver IC) 12 that controls driving (energization) of the heat generating resistor element array 11 according to, for example, a print data signal DI that is directly fed from a set-side interface circuit 20' (hereinafter, set-side I/F 20').

Examples of conventional arts related to the above description are disclosed in Patent Documents 1 to 4 listed below filed by the applicant of the present application.

Examples of conventional arts related to prevention of electromagnetic interference (EMI) occurring in data transmission from a set-side interface section to a thermal head, speeding-up of data transfer, and reduction of the number of signal lines are disclosed in, for example, Patent Documents 5 and 6 listed below.

Patent Document 1 JP-A-H04-16364
Patent Document 2 JP-A-H04-16365
Patent Document 3 JP-A-H04-305471
Patent Document 4 JP-A-H04-323048
Patent Document 5 JP-A-2002-326348
Patent Document 6 JP-A-2006-198910

DISCLOSURE OF THE INVENTION

Problems to be Solved by the Invention

It is true that, with the conventional thermal head 10' shown in FIG. 3, direct printing onto thermal paper and ink-ribbon printing onto regular paper can be performed by selectively energizing heat generating resistor elements in the heat generating resistor element array 11 according to, for example, the print data signal DI fed from the set-side I/F 20'.

However, since the above-described thermal head 10' is structured to receive power supply voltages (a first power supply voltage VH, a second power supply voltage VDD, and a ground voltage GND), the print data signal DI, a clock signal CLK, and various control signals (a latch signal LAT, strobe signals STB1 to STB6, and an enable signal AE) from the set-side I/F 20' in a parallel manner, if the number of power supply voltages and that of signals need to be increased, the number of power supply cables and that of signal cables need to be increased to achieve such increases. This invites an increase in device size; it also sets an upper limit to the number of the power supply cables and to that of the signal cables in a case where the number of connector terminals is fixed.

Also, with the above-described conventional structure in which the power supply voltages and various control signals are received in a parallel manner, since different thermal heads 10' require different numbers of connector terminals, it is impossible to standardize the set-side I/F 20'.

Also, with the above-described conventional structure in which the various control signals are directly fed to the driver circuit 12 of the thermal head 10', since the speed at which data is transferred from the set-side I/F 20' to the thermal head 10' is limited according to the processing speed of the driver circuit 12 (the frequency of the clock signal CLK fed to the driver circuit 12), it is difficult to fully exploit the processing capacity of the set-side I/F 20' in some cases.

Also, with the above-described conventional thermal head 10', it is quite difficult to cope with electromagnetic interference, and as a measure to cope with electromagnetic interference, for example, the length of a cable that connects the set-side I/F 20' and the thermal head 10' is limited, which is not necessarily advantageous for usability.

Also, since the above-described thermal head 10' receives, from the set-side I/F 20', not only the first power supply voltage VH (e.g., 8 to 20 V) that is applied to one terminal of the heat generating resistor element array 11 but also the second power supply voltage VDD (e.g., 5 V or 3.3V) for driving the driver circuit 12, the print characteristic of the thermal head 10' disadvantageously depends on the second power supply voltage VDD (and thus, on the level of an input signal).

A specific description will be given of the above described problems with reference to FIG. 4.

FIG. 4 is a circuit diagram schematically showing an output stage of each of logic gate circuits (NAND circuits) 123 in the driver circuit 12.

In the case where an N-channel field-effect transistor N1 is used as the output stage of each of the logic gate circuits 123 as shown in this figure, on resistance of the transistor N1 decreases with increase of high-level potential of the gate of the transistor N1 (the second power supply voltage VDD), and the on resistance increases with decrease of the high-level potential.

Thus, in order to supply an ample amount of current to the heat generating resistor element array 11, it is preferable to apply as high a gate voltage as possible to the transistor N1 to turn it on, and thus it is preferable for the second power supply voltage VDD supplied to the transistor N1 to be as high as possible. However, in the case where voltage level of the second power supply voltage VDD fed from the set-side I/F 20' is lowered, for example, in order to reduce power consumption of the set, the print characteristic (energization characteristic) of the thermal head 10' also changes accordingly, which is quite inconvenient.

In view of the above described problems, an object of the present invention is to provide a thermal head that is capable of preventing electromagnetic interference occurring in transmitting data from a set-side interface section to the thermal head, speeding-up data transfer, and reducing the number of signal cables, and that is further capable of eliminating dependence of the print characteristic on the level of an input signal, and an image forming apparatus using this.

Means for Solving the Problem

To achieve the above object, according to one aspect of the present invention, a thermal head includes: a heat generating element; a driver circuit for controlling driving of the heat generating element; and a head-side interface section. Here, the head-side interface section includes: a low-voltage differential signaling receiver that receives a low-voltage differential signal from a set-side interface section and outputs the low-voltage differential signal as a single-ended signal; a decoder that divides the single-ended signal into a data signal string and a trigger signal; and a clock generating section that generates a clock signal that is synchronized with the trigger signal, and the driver circuit reads a print data signal and various control signals in the data signal string in response to the clock signal, and controls the driving of the heat generating element according to the print data signal and the various control signals.

Other features, components, steps, advantages, and characteristics of the present invention will be disclosed in the following detailed description of the best mode for carrying out the present invention and relevant attached drawings.

ADVANTAGES OF THE INVENTION

With a thermal head of the present invention and an image forming apparatus using this, it is possible to prevent electromagnetic interference occurring in transmitting data from a set-side interface section to the thermal head, to speed-up data transfer, and to reduce the number of signal cables, and furthermore, it is possible to eliminate dependence of print characteristic on an input signal level.

LIST OF REFERENCE SYMBOLS

Figure 1:
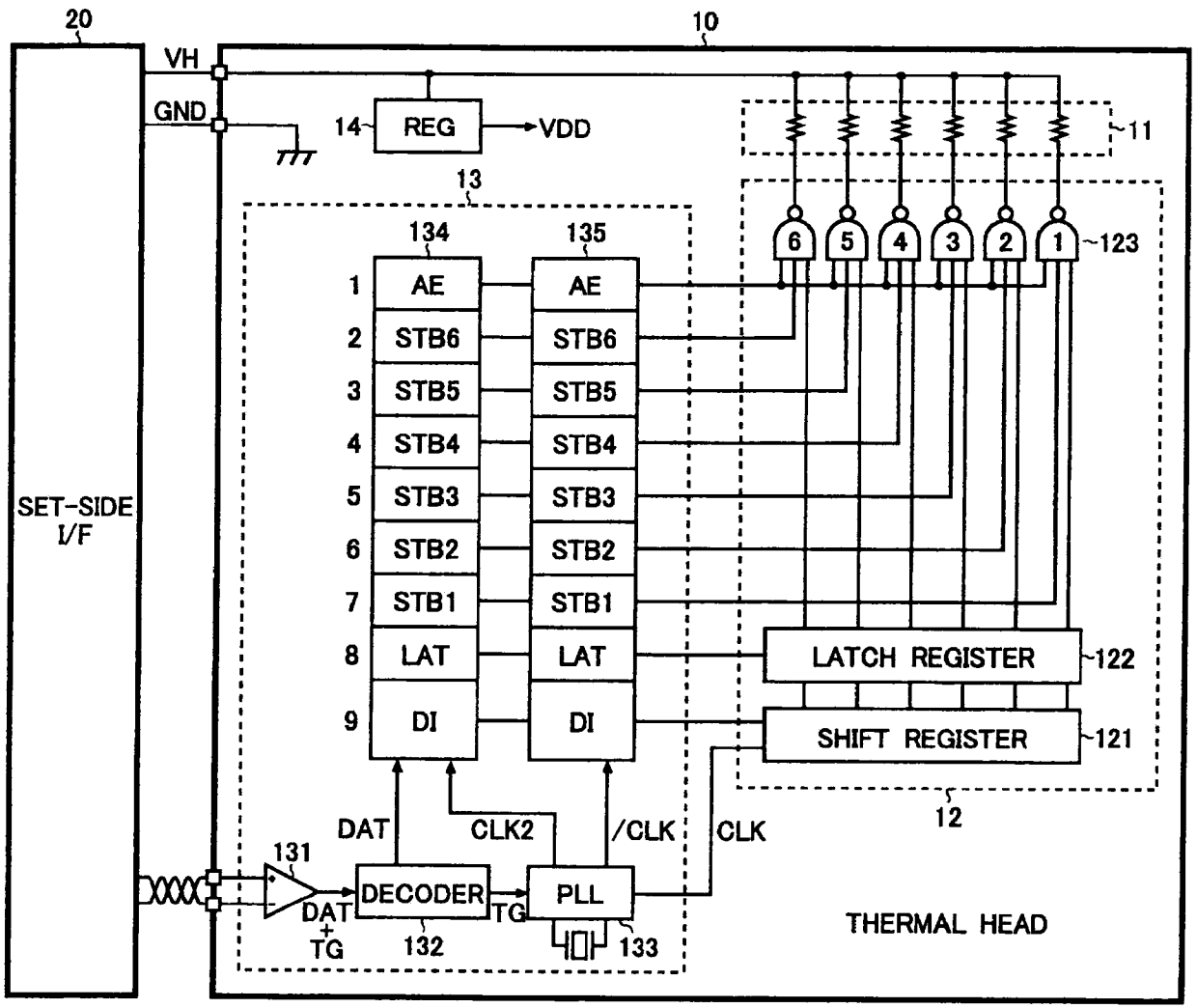
FIG. 1 is a diagram showing a thermal head embodying the present invention.

10 thermal head
11 heat generating resistor element row
12 driver circuit (driver IC)
121 shift register
122 latch register
123 logic gate circuits
13 head-side interface circuit (head-side I/F)
131 low-voltage differential signaling receiver (LVDS receiver)
132 decoder
133 clock generating section (PLL)
134 shift register
135 latch register
14 internal power supply voltage generating section
20 set-side interface circuit (set-side I/F)
VH first power supply voltage
VDD second power supply voltage (internal power supply voltage)
GND ground voltage
DAT data signal string
TG trigger signal
DI print data signal
CLK clock signal
CLK2 multiplied clock signal
LAT latch signal
STB1 to STB6 strobe signals
AE enable signal

BEST MODE FOR CARRYING OUT THE INVENTION

FIG. 1 is a diagram showing a thermal head embodying the present invention.

As shown in this figure, a thermal head 10 of this embodiment includes a heat generating resistor element array 11, a driver circuit (driver IC) 12, and it also includes a head-side interface section 13 (hereinafter, head-side I/F 13) and an internal power supply voltage generating section 14.

The thermal head 10 of this embodiment also includes, as external terminals for achieving electrical connection with a set-side interface section 20 (hereinafter, set-side I/F 20), a first power supply voltage VH application terminal to which a first power supply voltage VH (e.g., 8 to 20 V) is applied, a ground voltage GND application terminal to which a ground voltage GND is applied, and a pair of signal input terminals used for low-voltage differential signaling.

The heat generating resistor element array 11 is formed of a plurality of heat generating resistor elements arranged in a line, the heat generating resistor elements corresponding to print dots. Incidentally, the first power supply voltage VH is applied to one terminal of each of the heat generating resistor elements.

The driver circuit 12 is a semiconductor integrated circuit device for controlling driving (energization) of the heat generating resistor element array 11 according to, for example, a print data signal DI that is fed from the set-side I/F 20 via the head-side I/F 13, and includes a shift register 121, a latch register 122, and logic gate circuits 123.

The shift register 121 is means for sequentially storing the print data signal DI while shifting the print data signal DI one cell at every rising edge of a clock signal CLK.

The latch register 122 is means for fetching, according to a latch signal LAT, the print data signal DI stored in cells of the shift register 121 to latch and output the print data signal DI.

That is, the shift register 121 and the latch register 122 function as serial/parallel converting means for converting the print data signal DI fed in a serial format from the head-side I/F 13 into a parallel format and feeding the resulting print data signal DI in the parallel format to the heat generating resistor element array 11 in a parallel manner.

Figure 4:
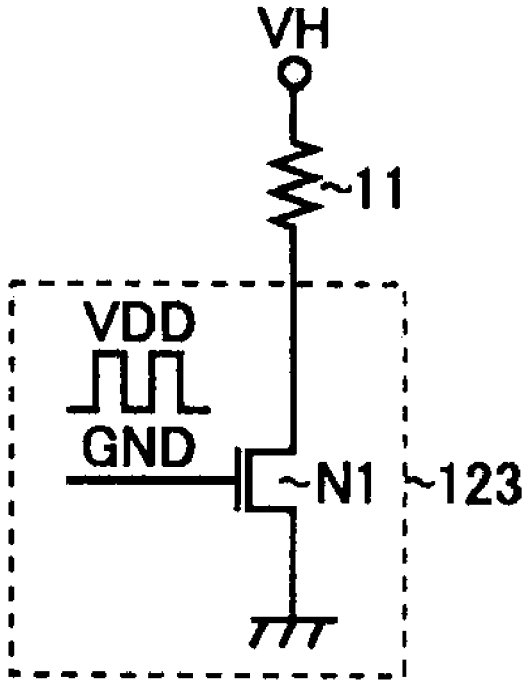
FIG. 4 is a circuit diagram schematically showing an output stage of a logic gate circuit 123.

The logic gate circuits 123 are each means for performing a logical operation (in this embodiment, a NAND operation) of a latch output signal of the latch register 122 (i.e., the print data signal DI from a corresponding cell), a corresponding one of strobe signals STB1 to STB6 (logic signals used, for example, for time-division control of print timing) from the corresponding cell, and an enable signal AE common to all the cells, and for controlling a potential of the other terminal of a corresponding one of the heat generating resistor elements in the heat generating resistor element array 11. Specifically, according to this embodiment, each of the logic gate circuits 123 is designed such that, with respect to the corresponding cell, if all the above-described three lines of input signals are all at high level, its output logic is at low level (the ground voltage GND) so that the corresponding one of the heat generating resistor elements is allowed to be energized, and on the other hand, if at least one of the above-described three lines of input signals is at low level, its output logic is at high level (the first power supply voltage VH) so that the corresponding one of the heat generating resistor elements is forbidden to be energized. Incidentally, the output stage of each of the logic gate circuits 123 is structured as shown in FIG. 4, which has been already referred to.

Thus, selective energization of the heat generating resistor elements in the heat generating resistor element array 11 according to, for example, the print data signal DI fed from the set-side I/F 20 via the head-side I/F 13 enables an image forming apparatus (such as a thermal printer) using the thermal head 10 to perform direct printing onto thermal paper and ink-ribbon printing onto regular paper.

The head-side I/F 13 includes a low-voltage differential signaling receiver 131 (hereinafter, LVDS receiver 131), a decoder 132, a clock generating section 133, a shift register 134, and a latch register 135.

The LVDS receiver 131 is means for receiving a low-voltage differential signal from the set-side I/F 20 via, for example, twisted cables, and converting the received low-voltage differential signal into a single-ended signal that is then outputted. Incidentally, the low-voltage differential signal includes, as shown in the top stage (indicating DAT+TG) in FIG. 2, a trigger signal TG that is used for controlling synchronization of the clock signal CLK in addition to the data signal string DAT; in the data signal string DAT, a number "n" (in this embodiment, n=9) of signals such as the print data signal DI and various control signals (in this embodiment, the latch signal LAT, the strobe signals STB1 to STB6, and the enable signal AE) are serially arranged. This data signal string DAT and the trigger signal TG together form a packet corresponding to one dot.

As described above, with the structure where the print data signal DI, the various control signals (the latch signal LAT, the strobe signals STB1 to STB6, and the enable signal AE) are fed from the set-side I/F 20 not in a parallel manner but in a serial manner as a low-voltage differential signal, the number of signal cables can be reduced, and what is more, fast signal transmission that is resistant to electromagnetic interference can be achieved.

Figure 2:
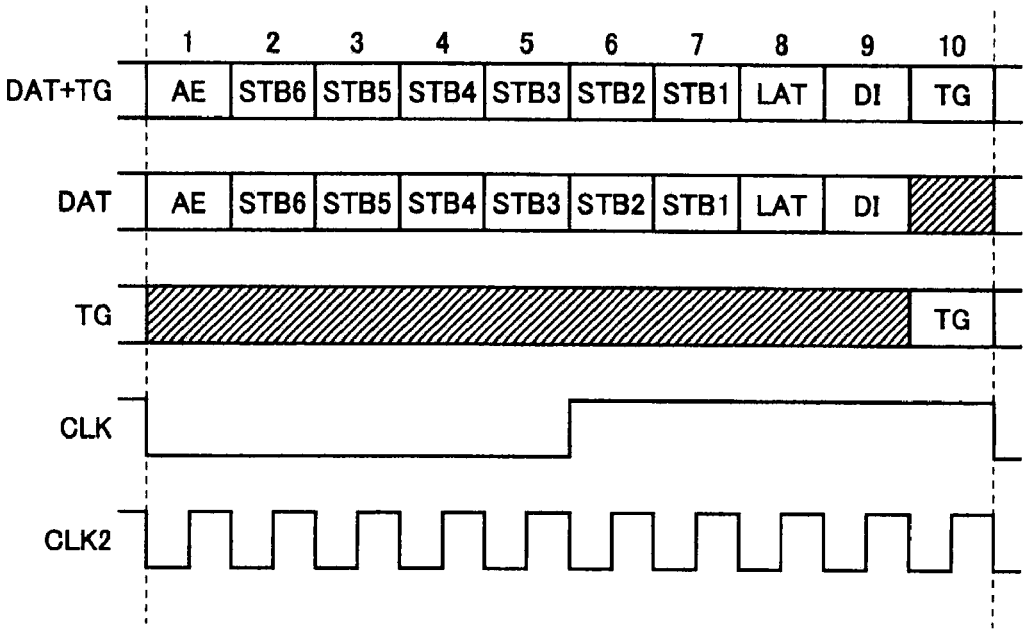
FIG. 2 is a diagram for illustrating how a trigger signal TG is separated from a data signal string DAT and how a clock signal CLK and a multiplied clock signal CLK2 are generated.
Figure 3:
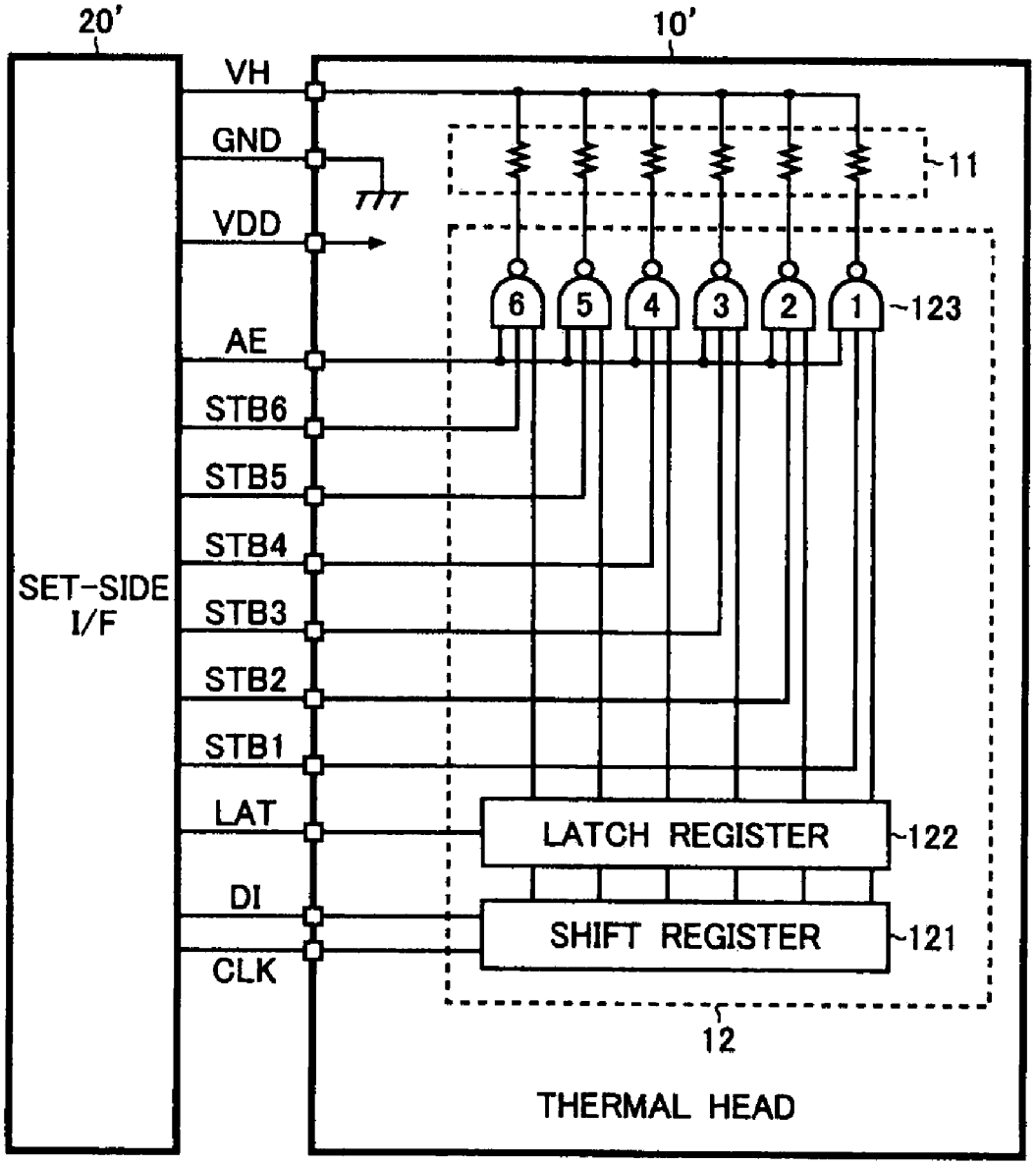
FIG. 3 is a diagram showing a conventional example of a thermal head.

The decoder 132 is means for dividing the single-ended signal fed from the LVDS receiver 131 into the data signal string DAT and the trigger signal TG as shown in the second and third stages from the top in FIG. 2 (indicating DAT and TG, respectively).

The clock generating section 133 includes an oscillator and a phase locked loop (PLL) circuit, and functions as means for generating the clock signal CLK that is synchronized by the trigger signal TG and a multiplied clock signal CLK2 (a signal obtained by multiplying the clock signal CLK by 10 (i.e., n+1)) as shown in the fourth and fifth stages from the top in FIG. 2 (indicating CLK and CLK2, respectively).

As described above, with the structure where the clock signal CLK and the multiplied clock signal CLK2 are generated on the thermal head 10 side in response to the trigger signal TG included in the low voltage differential signal, it is possible to reduce the number of signal cables. Also, by setting the frequency of the multiplied clock signal CLK2 according to the capacity of the data signal string DAT (i.e., the number "n" that indicates the quantity of signals in the data signal string DAT), the rate of data transmission from the set-side I/F 20 to the thermal head 10 can be improved up to a desired rate (e.g., several hundred MHz) without being limited by the processing rate of the driver circuit 12 (e.g., 16 MHz). Thus, any increase in the various control signals can be dealt with without delay, and the processing capacity of the set-side I/F 20 can be fully exploited.

The shift register 134 is means for sequentially storing the data signal string DAT while shifting the data signal string DAT one cell at every rising edge of the multiplied clock signal CLK2. Incidentally, since solely the data signal string DAT and no trigger signal TG is fed to the shift register 134 from the decoder 132, a rising edge of the multiplied clock signal CLK2 at the timing (in this embodiment, the tenth (n+1th) rising edge) is neglected (see the hatched area in the second stage from the top in FIG. 2).

The latch register 135 is means for fetching the data signal string DAT stored in the cells of the shift register 134 in response to a rising edge of an inverted clock signal /CLK (in other words, a falling edge of the clock signal CLK), to latch and output the data signal string DAT.

That is, the shift register 134 and the latch register 135 function as a serial/parallel converting means for converting the data signal string DAT fed in a serial format from the decoder 132 into a parallel format, and feeding the resulting data signal string DAT to the driver circuit 12 in a parallel manner. With a structure provided with such serial/parallel converting means, since the driver circuit does not need to be modified in any manner, a commercially available conventional driver circuit can be used as the driver circuit 12.

The internal power supply voltage generating section 14 is means for generating a second power supply voltage VDD (for example, 5V) as desired from the first power supply voltage VH, and it can be, for example, a step-down series regulator or a switching regulator. With this structure, where the second power supply voltage VDD for driving the driver circuit 12 and the head-side I/F 13 is generated on the thermal head 10 side, the number of power supply cables can be reduced, and furthermore, even in the case where the set-side I/F 20 is driven at a low voltage (e.g., 3.3 V voltage specification) to reduce power consumption of the set, the print characteristic (energization characteristic) of the thermal head 10 remains unchanged regardless of the specification.

Also, as described above, with the structure where the low-voltage differential signal is received in a serial manner from the set-side I/F 20 and the clock signal CLK and the second power supply voltage VDD are both internally generated, the set-side I/F 20 and the thermal head 10 can be connected to each other only with a pair of differential signal cables and two power supply cables regardless of how many functions the thermal head 10 is provided with. As a result, the number of cables can be standardized at "four (4)", leading to standardization of the set-side I/F 20.

The present invention may be carried out in any manner other than specifically described above as an embodiment, and many modifications and variations are possible within the scope and spirit of the present invention.

For example, the number of heat generating resistor elements in the heat generating resistor element array 11 is not limited to that adopted in the above embodiment, and can be changed as necessary. Also, the kind, the number, and the input order of the control signals included in the data signal string DAT are not limited to those adopted in the above embodiment, and can be changed as necessary.

INDUSTRIAL APPLICABILITY

The present invention is preferably applicable to image forming apparatuses that perform direct printing onto thermal paper or ink-ribbon printing onto regular paper (thermal printers).

What is claimed is:

1. A thermal head comprising:

a heat generating element;

a driver circuit for controlling driving of the heat generating element; and a head-side interface section, wherein the head-side interface section includes:

a low-voltage differential signaling receiver arranged to receive a low-voltage differential signal from a set-side interface section, and to convert the low-voltage differential signal into a single-ended signal that is then provided as an output;

a decoder arranged to divide the single-ended signal into a data signal string and a trigger signal; and a clock generating section arranged to generate a clock signal that is synchronized by the trigger signal, and wherein the driver circuit is arranged to read a print data signal and control signals included in the data signal string in response to the clock signal, and to control the driving of the heat generating element according to the print data signal and the control signals.

2. The thermal head of claim 1 wherein the head-side interface section includes a serial/parallel converting section arranged to convert the data signal string fed in a serial format from the decoder into a parallel format in response to the clock signal and a multiplied clock signal generated by multiplying the clock signal, and wherein the head-side interface section is arranged to feed the data signal string that has been converted into the parallel format to the driver circuit in a parallel manner.

3. The thermal head of claim 2 wherein the serial/parallel converting section includes:

a shift register arranged to sequentially store the data signal string while shifting the data signal string one cell every time the shift register receives the multiplied clock signal; and a latch register arranged to fetch the data signal string stored in cells of the shift register, and to latch and provide as an output the data signal string.

4. The thermal head of any one of claims 1 to 3 further comprising:

an internal power supply voltage generating section arranged to generate a second power supply voltage from a first power supply voltage applied to one terminal of the heat generating element, and to feed the second power supply voltage to the driver circuit and to the head-side interface section.

5. An image forming apparatus comprising:

the thermal head of any one of claims 1 to 3; and the set-side interface section arranged to supply the thermal head with the low-voltage differential signal.

6. A head-side interface incorporated in a thermal head comprising:

a low-voltage differential signaling receiver arranged to receive a low-voltage differential signal from a set-side interface section and to convert the low-voltage differential signal into a single-ended signal that is then provided as an output;

a decoder that arranged to divide the single-ended signal into a data signal string and a trigger signal; and a clock generating section arranged to generate a clock signal that is synchronized with the trigger signal.

7. The head-side interface of claim 6 further comprising:

a serial/parallel converting section arranged to convert the data signal string fed from the decoder in a serial format into a parallel format in response to the clock signal and a multiplied clock signal generated by multiplying the clock signal.

8. The head-side interface of claim 7 wherein the serial/parallel converting section includes:

a shift register arranged to sequentially store the data signal string while shifting the data signal string one cell every time the shift register receives the multiplied clock signal; and a latch register arranged to fetch the data signal string stored in cells of the shift register, and to latch and provide as an output the data signal string.

9. An image forming apparatus comprising:

the thermal head of claim 4; and the set-side interface section arranged to supply the thermal head with the low-voltage differential signal.

* * * * *